US012709786B2

(12) United States Patent
Vandaele

(10) Patent No.: US 12,709,786 B2
(45) Date of Patent: Aug. 18, 2026

(54) SELECTIVE RECOVERY OF Li

(71) Applicant: Gelion Technologies Pty Ltd, Eveleigh (AU)

(72) Inventor: Koen Vandaele, Reading (GB)

(73) Assignee: Gelion Technologies Pty Ltd. (AU)

( * ) Notice: Subject to any disclaimer, the term of this patent is extended or adjusted under 35 U.S.C. 154(b) by 619 days.

(21) Appl. No.: 18/032,007

(22) PCT Filed: Sep. 20, 2021

(86) PCT No.: PCT/GB2021/052430
§ 371 (c)(1),
(2) Date: Apr. 14, 2023

(87) PCT Pub. No.: WO2022/079409
PCT Pub. Date: Apr. 21, 2022

(65) Prior Publication Data

US 2023/0383379 A1 Nov. 30, 2023

(30) Foreign Application Priority Data

Oct. 15, 2020 (GB) ..... 2016329

(51) Int. Cl.
*C22B 26/12* (2006.01)
*C22B 7/00* (2006.01)

(52) U.S. Cl.
CPC ..... *C22B 26/12* (2013.01); *C22B 7/007* (2013.01)

(58) Field of Classification Search
CPC ..... C22B 26/12; C22B 7/007; C22B 3/165; C22B 3/44; C22B 3/16; Y02P 10/20; Y02W 30/84; H01M 10/54
See application file for complete search history.

(56) References Cited

U.S. PATENT DOCUMENTS

2023/0187720 A1 6/2023 Sonoc et al.

FOREIGN PATENT DOCUMENTS

| | | | |
|---|---|---|---|
| CN | 104686190 | A | 6/2015 |
| CN | 110563044 | A | 12/2019 |
| CN | 111621643 | A | 9/2020 |
| WO | 2021226719 | A1 | 11/2021 |

OTHER PUBLICATIONS

English machine translation of CN 111621643 A (Year: 2020).*
Chen et al., "Thermal treatment and ammoniacal leaching for the recovery of valuable metals from spent lithium-ion batteries" Waste Management 75, Mar. 2018, 469-476 (Year: 2018).*
Li et al., "Recovery of valuable metals from spent lithium-ion batteries by ultrasonic-assisted leaching process" Journal of Power Sources 262, Apr. 2014, 380-385 (Year: 2014).*
Zheng et al., "Spent lithium-ion battery recycling - Reductive ammonia leaching of metals from cathode scrap by sodium sulphite" Waste Management 60, Dec. 2016, 680-688 (Year: 2016).*
International Search Report issued in PCT/GB2021/052430.
XP055523696, Solvometallurgy: An Emerging Branch of Extractive Metallurgy, Koen Binnemans; Peter Tom Jones, Journal of Sustainable Metallurgy, 20170901 Springer International Publishing, DE—ISSN 2199-3823, vol. 3, Nr:3, pp. 570-600, http://dx.doi.org/10.1007/s40831-017-0128-2.
XP055853060, Lithium Carbonate Recovery from Cathode Scrap of Spent Lithium-Ion Battery: A Closed-Loop Process, Gao Wenfang; Zhang Xihua; Zheng Xiaohong; Lin Xiao; Cao Hongbin; Zhang Yi; Sun Zhi, Environmental Science & Technology, 20170207 American Chemical Society, US—ISSN 0013-936X, vol. 51, Nr:3, pp. 1662-1669, https://pubs.acs.org/doi/pdf/10.1021/acs.est.6b03320, http://dx.doi.org/10.1021/acs.est.6b03320.
Xiaohong Zheng et al. A Mini-Review on Metal Recycling from Spent Lithium Ion Batteries, Engineering, vol. 4, Issue 3, Jun. 2018, pp. 361-370.
Jiang F et al. Ultrasound-assisted leaching of cobalt and lithium from spent lithium-ion batteries. Ultrason Sonochem. Nov. 2018;48:88-95.

* cited by examiner

*Primary Examiner* — Anthony J Zimmer
*Assistant Examiner* — Abdul-Rahman Yusuf Waleed Smari
(74) *Attorney, Agent, or Firm* — The Belles Group, P.C.

(57) ABSTRACT

A method for selectively removing Li from an input material comprising Li and one or more transition metals, comprising the steps of: contacting said input material with a leaching medium comprising formic acid; and leaching Li from the input material to form a leachate; wherein the concentration of formic acid in the leaching medium is at least 70 wt. %.

15 Claims, 5 Drawing Sheets

SELECTIVE RECOVERY OF Li

CROSS-REFERENCE TO RELATED PATENT APPLICATIONS

The present application is a U.S. national stage application under 35 U.S.C. § 371 of PCT Application No. PCT/GB2021/052430, filed Sep. 20, 2021, which claims priority to United Kingdom Patent Application No. 2016329.1, filed Oct. 15, 2020. The disclosures of the aforementioned priority applications are incorporated herein by reference in their entireties.

TECHNICAL FIELD

The present specification relates to the selective recovery of Li from an input material comprising a mixture of Li and one or more transition metals.

BACKGROUND ART

The number of portable electronic devices requiring rechargeable batteries (e.g. smartphones and laptops) is increasing year on year. With growing concerns for the environment, the automotive sector is looking for alternatives to the internal combustion engine and rechargeable batteries provide one solution. With increasing consumer take-up of hybrid and fully electric vehicles powered by rechargeable batteries, the world's demand for rechargeable batteries is only expected to grow.

Modern rechargeable batteries typically include a cathode material based on a transition metal oxide framework containing intercalated lithium. Examples include $LiCoO_2$, $LiMn_2O_4$, $LiFePO_4$, $LiNiCoAlO_2$ and $LiNi_xMn_yCo_zO_2$ ("NMC"). One material showing promise for automotive applications is "NMC" (lithium-nickel-manganese-cobalt), which is represented by the general formula $LiNi_xMn_yCo_zO_2$ where $x+y+z=1$. There is a desire to provide routes to recover and recycle the metals used in the cathode materials of batteries. This is particularly important for Co, Ni and Li, and to a lesser extent Mn.

The recovery of Li, Ni, Mn and Co from NMC materials has been studied previously. In a typical process the metals are solubilized from cathode scrap using an acidic leaching medium (e.g. sulphuric acid) to form a leachate containing metal ions, and are then separated by a series of precipitations using pH adjustment and/or solvent extractions. Fe, Al and Cu may be removed from the leachate by various methods including sulfiding or precipitation using NaOH. Mn, Co and Ni are typically separated from the leachate by precipitation and/or solvent extraction, but are often contaminated with Li impurities. Li is usually the last material left in solution and is precipitated e.g. as $Li_2CO_3$. However, at this stage the leachate includes sodium ions which were introduced previously when precipitating Fe, Al and Cu, and during the solvent extraction. The precipitation of Li often uses $Na_2CO_3$ as a source of carbonate and is prone to producing $Li_2CO_3$ contaminated with $Na_2CO_3$, from which it is difficult to obtain high purity Li. It would therefore be advantageous if Li could be removed from the cathode scrap upstream, before carrying out pH adjustment.

In a paper by Gao et al. (*Environ. Sci. Technol.* 2017, 51, 1662-1669) the authors describe the recovery of Li, Ni, Mn and Co from NMC cathode scrap using a leaching solution comprising aqueous formic acid and hydrogen peroxide. Formic acid serves a dual role in this process. Firstly, formic acid acts as a reducing agent to convert insoluble +3 transition metal ions present in the NMC into soluble +2 ions. Hydrogen peroxide is added to assist in this reduction. Secondly, formic acid forms complexes with the Li(I), Ni(II), Mn(II) and Co(II) ions in solution.

The Gao paper mentioned above investigates the influence of parameters including the content of reducing agent, formic acid concentration, solid to liquid ratio (S/L), temperature and time on the selectivity of metals extracted from the cathode scrap. In one set of experiments the recovery of Li, Ni, Mn and Co from spent NMC cathode material was investigated by treating the material with a formic acid solution at a leaching temperature of 60° C. over a period of 120 min. The leaching rate of each metal increased as the formic acid concentration was increased. While in each case a larger proportion of the Li was leached as compared with the amounts of Ni, Mn or Co, in every case a significant amount of Ni, Mn and Co were present in the leachate, which require separation through subsequent precipitation steps. Similar results were obtained when using a mixture of dilute formic acid and $H_2O_2$ as the leaching medium. While over time the content of Co(II), Ni(II) and Mn(II) ions in the leachate reached a maximum and then began to decrease, which was attributed to precipitation of the ions as hydroxide, the leachate always contained significant amounts of transition metal ions.

To provide a more straightforward recycling route, particularly for Li-ion battery scrap, it would be advantageous to provide a method which could selectively remove Li from an input material. The present specification addresses this problem.

SUMMARY OF THE INVENTION

Describe herein is a method for selectively removing Li from an input material comprising Li and one or more transition metals, comprising the steps of:

contacting said input material with a leaching medium comprising formic acid; and leaching Li from the input material to form a leachate;

wherein the concentration of formic acid in the leaching medium is at least 40 wt. %.

The present inventors have surprisingly established that it is possible to selectively leach Li from the input material if the concentration of formic acid in the leaching medium is sufficiently high. This is surprising, especially in view of the results by Gao et al. (*Environ. Sci. Technol.* 2017, 51, 1662-1669) which show that Ni, Mn and Co are all leached when using dilute solutions of aqueous formic acid as leaching medium (formic acid concentration of at most 4.5 mol/L, corresponding to approximately 20 wt. % formic acid).

Without wishing to be bound by any theory, it is thought that the high selectivity for leaching of Li is a result of the poor solubility of transition metals at the high concentrations of formic acid used in the process described herein. In contrast, Li ions are highly soluble in formic acid and form soluble lithium formate in situ. Previous reports of separating these metals from NMC cathode scrap only investigated the use of dilute formic acid (*Environ. Sci. Technol.* 2017, 51, 1662-1669), under which conditions the Ni(II), Co(II) and Mn(II) have appreciable solubility in the leaching medium.

DETAILED DESCRIPTION

Figure 1:
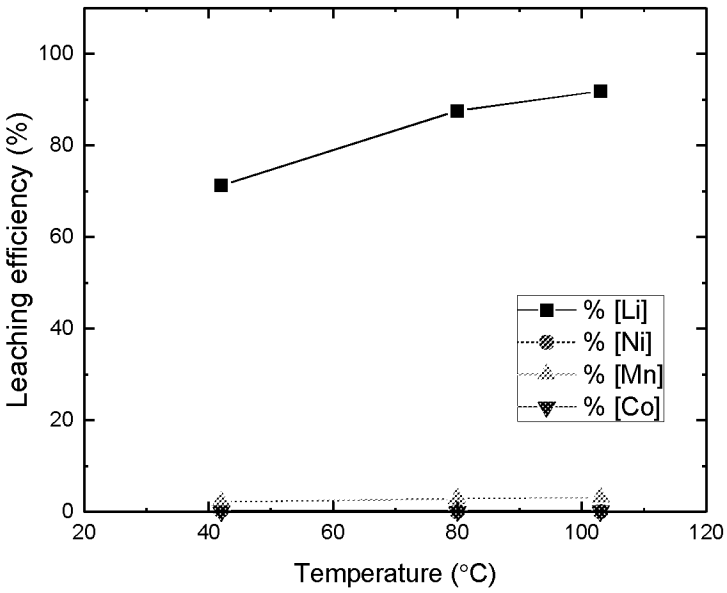
FIG. 1. Results using 98% formic acid as leaching medium on NMC-111 as input material. The left hand image shows the selectivity of the leaching medium and the right hand image shows the efficiency of the leaching medium.
Figure 1:
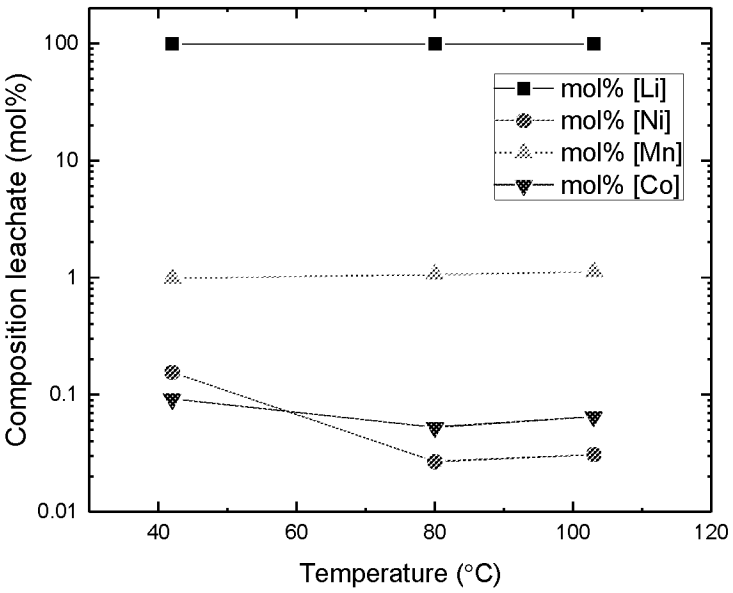

The instant specification describes a method for selectively removing Li from an input material comprising Li and one or more transition metals, comprising the steps of:

contacting said input material with a leaching medium comprising formic acid; and leaching Li from the input material to form a leachate;

wherein the concentration of formic acid in the leaching medium is at least 40 wt. %.

The process described in the present specification is carried out on an input material comprising lithium and one or more transition metals. The input material is typically a solid. The material will typically be battery scrap, typically a mixture of anode and cathode scrap from a Li-ion battery, especially cathode scrap from a Li-ion battery.

The battery scrap may have been previously used within an electrical energy storage device, although this is not essential. The battery scrap may be waste material generated during the production of batteries or materials, including for example waste intermediate materials or failed batches. In some embodiments, the battery scrap is formed by mechanical and/or chemical processing of waste lithium ion batteries.

In some embodiments, the input material comprises lithium and one or more of iron, nickel, cobalt and manganese. In some embodiments, the input material comprises lithium, nickel and cobalt. In some embodiments the input material comprises lithium, nickel, cobalt and manganese.

As the skilled person will understand, the input material may further comprise other elements and/or materials derived from the electrochemical storage device, such as other elements derived from the cathode material, the current collector, the anode material, the electrolyte and any battery or cell casings.

In preferred embodiments the material comprises one or more of nickel, manganese and cobalt, in addition to Li. In some embodiments the material includes each of nickel, manganese and cobalt, in addition to Li.

The input material may comprise at least 10 wt % Ni based on the total mass of input material, for example at least 12 wt %, at least 15 wt %, at least 20 wt % or at least 25 wt %.

The input material may comprise up to 80 wt % Ni based on the total mass of input material, for example up to 75 wt %, up to 70 wt % or up to 50 wt %. The input material may comprise from 10 to 80 wt % Ni based on the total mass of input material.

The input material may comprise at least 0 wt % Mn based on the total mass of input material, for example at least 1 wt %, at least 2 wt %, at least 5 wt % or at least 10 wt %. The input material may comprise up to 33 wt % Mn based on the total mass of input material, for example up to 30 wt %, up to 28 wt % or up to 25 wt %. The input material may comprise from to 33 wt % Mn based on the total mass of input material.

The input material may comprise at least 0 wt % Co based on the total mass of input material, for example at least 1 wt %, at least 2 wt %, at least 5 wt % or at least 10 wt %. The input material may comprise up to 33 wt % Co based on the total mass of input material, for example up to 30 wt %, up to 28 wt % or up to 25 wt %. The input material may comprise from to 33 wt % Co based on the total mass of input material.

The input material may comprise at least 0 wt % Li based on the total mass of input material, for example at least 1 wt %, at least 2 wt %, at least 5 wt % or at least 6 wt %. The input material may comprise up to 20 wt % Li based on the total mass of input material, for example up to 18 wt %, up to 15 wt % or up to 12 wt %. The input material may comprise from to 20 wt % Li based on the total mass of input material.

The input material may comprise at least 0 wt % Fe based on the total mass of input material, for example at least 1 wt %, at least 2 wt % or at least 3 wt %. The input material may comprise up to 10 wt % Fe based on the total mass of input material, for example up to 9 wt %, up to 8 wt % or up to 7 wt %. The input material may comprise from 0 to 10 wt % Fe based on the total mass of input material.

The input material may comprise at least 0 wt % Al based on the total mass of input material, for example at least 1 wt %, at least 2 wt % or at least 3 wt %. The input material may comprise up to 10 wt % Al based on the total mass of input material, for example up to 9 wt %, up to 8 wt % or up to 7 wt %. The input material may comprise from 0 to 10 wt % Al based on the total mass of input material.

The input material may comprise at least 0 wt % Cu based on the total mass of input material, for example at least 1 wt %, at least 2 wt % or at least 3 wt %. The input material may comprise up to 20 wt % Cu based on the total mass of input material, for example up to 15 wt %, up to 10 wt %, ip to 9 wt %, up to 8 wt % or up to 7 wt %. The input material may comprise from 0 to 20 wt % Cu based on the total mass of input material.

The input material may comprise at least 0 wt % C based on the total mass of input material, for example at least 1 wt %, at least 5 wt %, at least 10 wt % or at least 15 wt %. The input material may comprise up to 50 wt % C based on the total mass of input material, for example up to 45 wt %, up to 40 wt % or up to 30 wt %. The input material may comprise from to 50 wt % C based on the total mass of input material.

The input material may comprise from 10 to 80 wt % Ni, from 0 to 33 wt % Mn, from 0 to 33 wt % Co, from 0 to 20 wt % Li, from 0 to 10 wt % Fe, from 0 to 10 wt % Al, from 0 to 10 wt % Cu and from 0 to 50 wt % C based on the total mass of input material.

Two important parameters to consider in a leaching process are the leaching efficiency and the leaching selectivity. The leaching efficiency is the proportion of a given metal in the input material which is leached by the leaching medium. For example, if an input material contains g of Li, and following leaching 9 g of Li has been leached, then the leaching efficiency for Li is 90%.

The leaching selectivity refers to the proportion of a given metal leached relative to the total of metals leached. In the Figures below, leaching selectivity is plotted based on the total molar content of metal ions in the leaching medium. For example, if following leaching the medium includes 0.95 mol Li and 0.05 mol Ni (a total of 1.0 mol metals) then the leaching selectivity for Li is 95%. Leaching selectivity is sometimes reported based on the total wt % of the metals leached, but this can obscure the selectivity because of the low mass of Li compared to other metals.

The process uses a leaching medium comprising formic acid at a concentration of at least 40 wt. %. While the highest selectivity for Li removal is achieved using essentially pure formic acid (98+% formic acid, see examples) and/or using high temperatures, in some embodiments it may be preferable to use a leaching medium of relatively dilute formic acid, e.g. at least 40 wt % formic acid with up to 60 wt % water or at least 50 wt % formic acid with up to 50 wt % water. While such solutions are not as selective for Li removal as 98+% formic acid, their use does not pose such a difficult engineering challenge as compared with highly concentrated formic acid, the latter requiring more expensive plant equipment. The use of a relatively dilute formic acid leaching medium also be preferably from a safety perspective because of its lower flammability as compared with concentrated formic acid. Manganese salts have been shown to be particularly detrimental to Li leaching selectivity because of their high solubility in aqueous formic acid. The use of relatively dilute formic acid leaching mediums may therefore be particularly tolerated when the substrate is substantially free from Mn.

Typically, the leaching medium will comprise formic acid at a concentration of at least 70 wt %. It has been found by the present inventors that such leaching mediums have a high leaching selectivity for Li. In preferred embodiments the concentration of formic acid in the leaching medium is at least 80 wt %. In preferred embodiments the concentration of formic acid in the leaching medium is at least 90 wt %, such as at least 98 wt %, such as at least 99 wt %. In general, the higher the concentration of formic acid in the leaching medium the higher the leaching selectivity for Li. A leaching medium of substantially pure formic acid has the advantage of high efficiency for Li removal and high selectivity for Li over other transition metals, particularly Ni, Mn and Co.

In some embodiments the leaching medium is an azeotrope of formic acid and water containing 77.5 wt % formic acid and 22.5 wt % water. As those skilled in the art will appreciate, the azeotrope boils without changing the ratio of formic acid to water. This allows the leaching medium to be more straightforwardly recycled, e.g. by boiling off from solvent from the leachate. As formic acid is consumed during the leaching process (e.g. through the production of lithium formate), a recycling loop will generally include steps to ensure that the azeotrope composition is maintained in the reactor, e.g. by adding fresh leaching medium with a concentration of formic acid greater than that in the azeotrope.

In some embodiments the leaching medium comprises $H_2O_2$. In addition to the formic acid, $H_2O_2$ helps to reduce transition metals in the input material (e.g. from the +3 or +4 oxidation states to the +2 oxidation state). When present in the leaching medium, the concentration of $H_2O_2$ in the leaching medium is preferably in the range of 1-10 wt. %, preferably 3-7 wt. %. Lower $H_2O_2$ concentrations are desirable from a safety perspective.

To ensure efficient contact between the leaching medium and input material in some embodiments leaching may be carried out with agitation of the substrate, for example using stirring or ultrasound.

The present inventors have established that in general, the higher the temperature during the leaching process the higher the leaching efficiency and leaching selectivity. It is preferred that during the leaching process the mixture of leaching medium and input material is heated to a temperature of at least 40° C. Typically, the temperature during the leaching process will be at least 60° C. in order to achieve high leaching efficiency. Preferably the temperature during the leaching process will be at least 80° C., in some embodiments at least 90° C. In some embodiments the mixture is heated at or above the boiling point of the leaching medium, for example under reflux.

The duration of heating should be sufficient to remove substantially all of the Li from the input material. This may depend in part on the temperature of the leaching medium and the physical form and chemical nature of the input material. Unnecessarily long durations are disfavoured on cost grounds. Suitable durations will readily be ascertained by those skilled in the art. When leaching is run as a batch process a typical duration of heating is 5-120 minutes, preferably 5-60 minutes.

The input material is typically contacted with the leaching medium at room temperature or above and then heated to the desired temperature. In some embodiments the leaching medium may be pre-heated before being contacted with the input material, without further heating of the mixture. Alternatively, the leaching medium may be at ambient temperature when contacted with the input material, and the mixture then heated to the desired temperature. It is also possible for the leaching medium to be pre-heated before being contacted with the input material, and the mixture then heated up further to the desired temperature.

An important parameter in a leaching process is the ratio of solid input material to leaching medium, referred to as S/L. During the leaching process, metals are dissolved into the leaching medium as the metal formates, of which Li formate is the most soluble. The formation of metal formates is also associated with the production of water (e.g. where the substrate is a metal oxide) which dilutes the leaching medium.

The use of a high S/L ratio is favoured on a number of grounds including: lower required volumes of leaching medium, meaning lower raw material costs, lower plant operation costs and reduced volumes of waste. At high S/L ratios the resulting leachate has a high concentration of lithium formate, which helps to suppress the dissolution of less soluble metal formate salts, e.g. of Mn, Ni or Co. On the other hand, at high S/L ratios the leaching medium is more prone to dilution from water formed as a by-product of the leaching process, which in unfavourable to leaching selectivity. In general, it is preferred that the S/L ratio is at least 10 g/L, preferably at least 20 g/L, more preferably at least 30 g/L. A typical range of values for S/L are 10-150 g/L, such as 20-150 g/L, such as 30-150 g/L.

In some embodiments additives may be added to the leaching medium to further prevent leaching of transition metals in the input material and thereby to improve the leaching selectivity for Li. The use of additives may be particularly appropriate when the S/L ratio is high and/or the leaching medium has a relatively low concentration of formic acid. The nature of the salt is not particularly critical, provided that it has a high solubility in the leaching medium and does not interfere with the leaching of Li or disrupt downstream steps. A preferred class of salts are sulphates, which have been found by the present inventors to prevent the leaching of transition metals, particularly Mn. The nature of the counterion in the sulphate salt is not particularly critical, but in order to avoid unnecessarily contaminating the leaching medium with additional metals, it is preferred that the counterion is a non-metal. A preferred additive is ammonium sulphate. The additives may be added to the leaching medium either before or after contacting with the input material. Typically, the additive will be added to the leaching medium in an amount of 10-100 g/L, such as 20-80 g/L or 20-50 g/L, these values being particularly suitable in the case of ammonium sulphate.

The process described herein results in the selective leaching of Li from the input material. Without wishing to be bound by theory, it is thought that initially the formic acid (and $H_2O_2$ if present), reduces metal ions in the input material, allowing Li ions to dissolve into the leaching medium. The resulting output material is a transition metal oxide. Over time, it is thought that this reacts with the excess of formic acid to produce the corresponding metal formate salt and water. The metal formate salts remain solid due their poor solubility in the leaching medium.

The invention will now be illustrated with the following non-limiting examples.

EXAMPLES

Materials

NMC 111—supplier Targray
Formic acid—98% grade Fisher Scientific
Ammonium sulphate—supplied by Acros Organics
Lithium Nickel Cobalt Oxide cathode material, available from Johnson Matthey Plc under trade name eLNO™

Example 1 (98 wt % Formic Acid+NMC 111)

2 g NMC 111 was added to 50 mL formic acid in a 100 mL round bottom flask equipped with a condenser. The suspension was stirred at 500 rpm, while the solution was heated to boiling (approx. 103° C.), typically requiring the heating plate to be set to 130° C. After 1 h, the solution was filtered and the leachate was analysed for elemental analysis using ICP-OES.

FIG. 1 shows that within 1 h, >90% Li was leached from the NMC 111, and Li accounted for >90 wt % of metals in the leachate. The leaching efficiency for Li increased as temperature was increased, without any sign of changes in leaching selectivity. Only a small amount of Mn dissolved into the leaching medium under each of the conditions, which increased slightly with increasing temperature. The leaching of Co and Ni was negligible.

Example 2 (98 wt % Formic Acid+NMC 111+ $(NH_4)_2SO_4$)

The procedure of Example 1 was followed but 2 g of $(NH_4)_2SO_4$ was added to the leachate.

Figure 2:
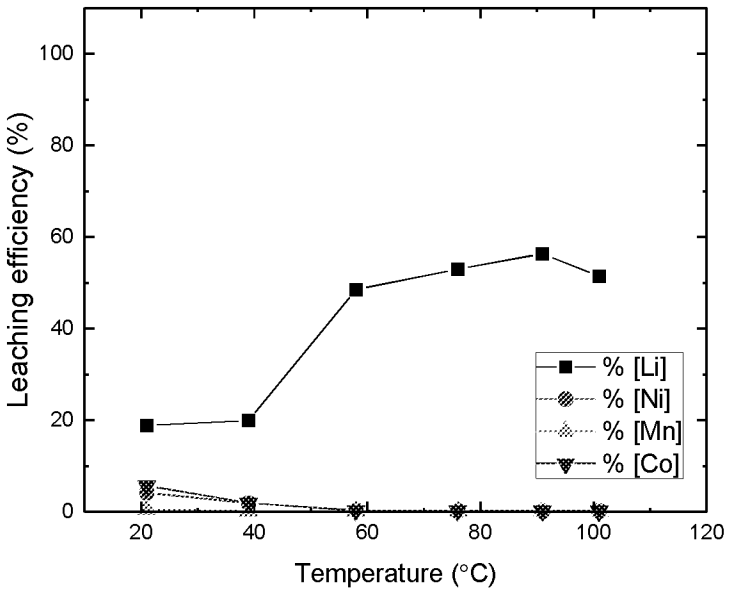
FIG. 2. Results using 98% formic acid as leaching medium with $(NH_4)_2SO_4$ as an additive on NMC-111 as input material. The left hand image shows the selectivity of the leaching medium and the right hand image shows the efficiency of the leaching medium.
Figure 2:
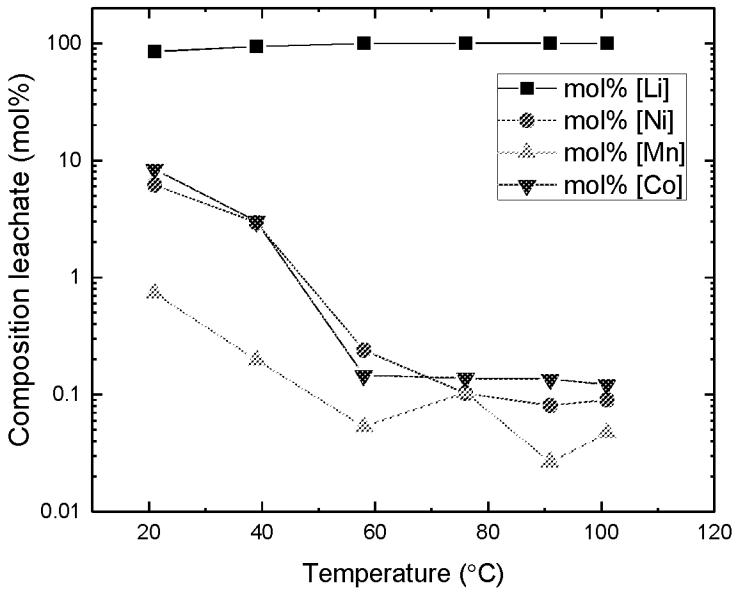

FIG. 2 shows that while leaching efficiency was not as high as for Example 1, at temperatures of 60° C. or above the leaching selectivity was higher than for Example 1, with hardly any leaching of Ni, Co or Mn.

Example 3 (77.5 wt % Formic Acid/22.5 wt % H2O+NMC111)

The procedure of Example 1 was followed using 50 mL of an azeotrope of formic acid and water (77.5% formic acid and 22.5% $H_2O$) in place of the 50 mL of formic acid.

Figure 3:
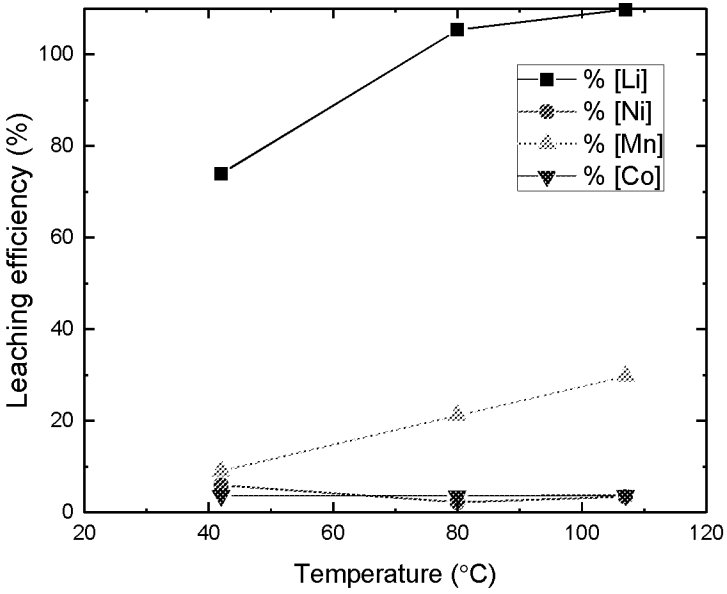
FIG. 3. Results using an azeotrope of 77.5 wt % formic acid/22.5 wt % water as leaching medium on NMC-111 as input material. The left hand image shows the selectivity of the leaching medium and the right hand image shows the efficiency of the leaching medium.
Figure 3:
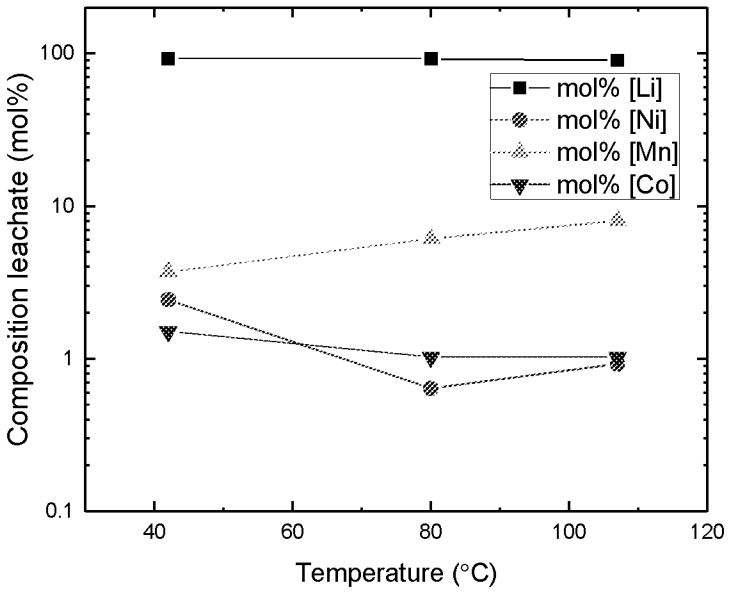

FIG. 3 shows that the use of a formic acid/water azeotrope as leaching medium still offered high leaching efficiency, although the leaching selectivity was not as high as when using 98% formic acid. The leaching of Mn(II) ions was significant, especially as the temperature was increased.

Example 4 (77.5 wt % Formic Acid/22.5 wt % $H_2O$+NMC111+$(NH_4)_2SO_4$)

The procedure of Example 3 was followed but 2 g $(NH_4)_2SO_4$ was added to the leaching medium.

Figure 4:
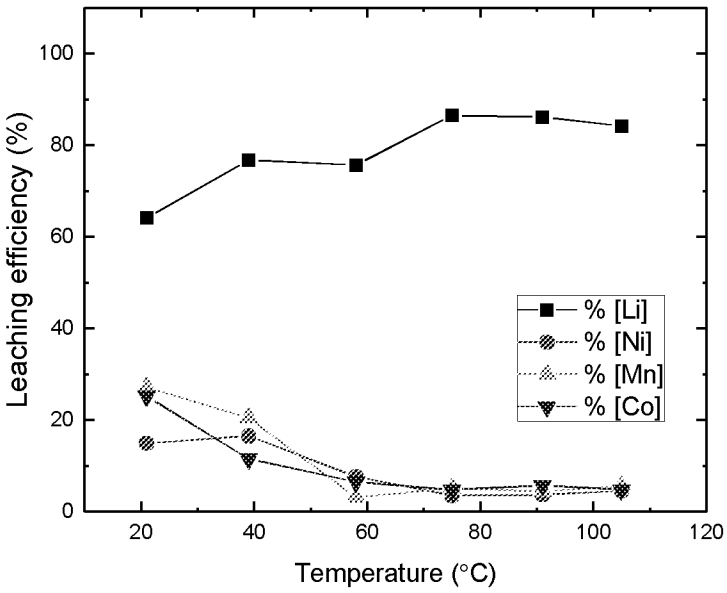
FIG. 4. Results using an azeotrope of 77.5 wt % formic acid/22.5 wt % water as leaching medium with $(NH_4)_2SO_4$ as an additive on NMC-111 as input material. The left hand image shows the selectivity of the leaching medium and the right hand image shows the efficiency of the leaching medium.
Figure 4:
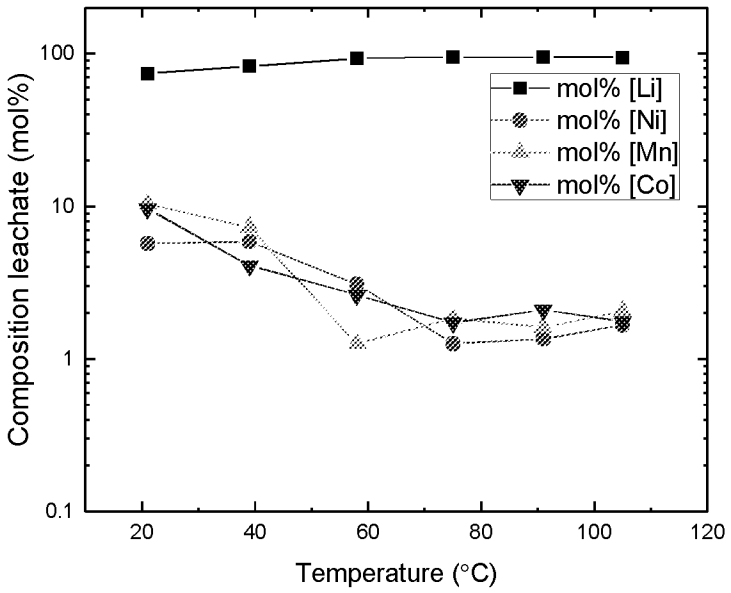

FIG. 4 shows that relative to the use of a formic acid/water azeotrope alone (Example 3), the inclusion of $(NH_4)_2SO_4$ resulted in a higher selectivity for Li, with a lower concentration of undesired metal ions in the leachate. In particular, the leaching of Mn was suppressed.

Example 5 (50 wt % Formic Acid/45 wt % $H_2O$+5% $H_2O_2$+eLNO)

The procedure of Example 1 was followed but the leaching medium a mixture of 50 wt % formic acid, 45 wt % water and 5 wt % $H_2O_2$, and 2 g lithium nickel cobalt oxide cathode material was used instead of 2 g of NMC 111.

Figure 5:
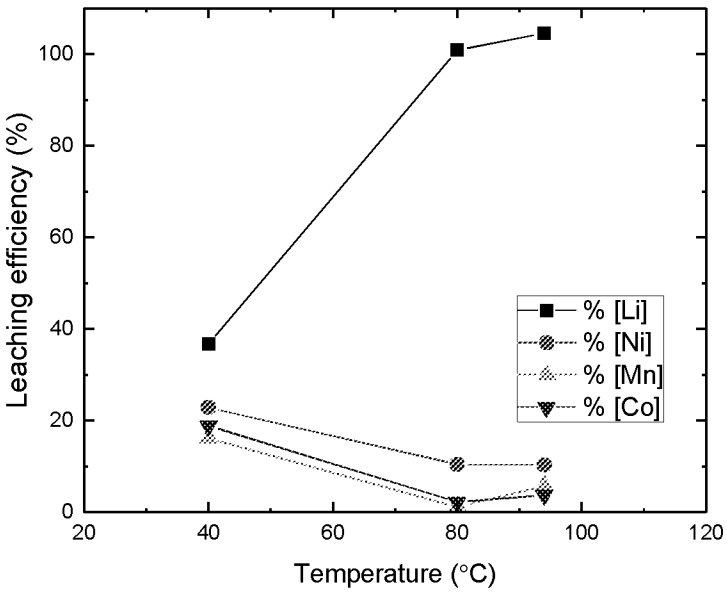
FIG. 5. Results using a solution of 50 wt % formic acid/45 wt % water/5 wt % $H_2O_2$ as leaching medium on eLNO as input material. The left hand image shows the selectivity of the leaching medium and the right hand image shows the efficiency of the leaching medium.
Figure 5:
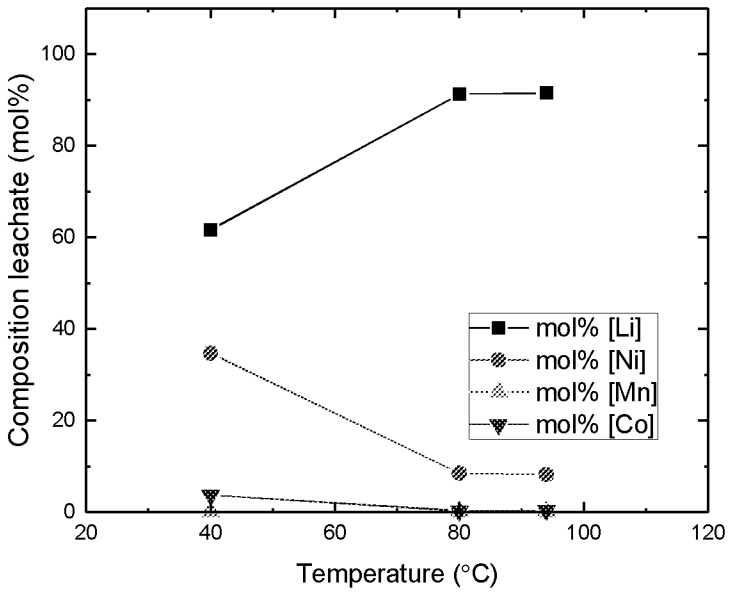

FIG. 5 shows that a high efficiency and relatively high selectivity of Li can be achieved using diluted performic acid as a leaching medium, although the leaching selectivity was not as high as for Examples 1-4 which used a more concentrated leaching medium.

The invention claimed is:

1. A method for selectively removing Li from an input material comprising Li and one or more transition metals, comprising the steps of:

contacting said input material with a leaching medium comprising formic acid and a sulphate salt; and leaching Li from the input material to form a leachate;

wherein the concentration of formic acid in the leaching medium is at least 70 wt. %.

2. A method as claimed in claim 1, wherein the input material comprises one or more of: nickel, manganese and/or cobalt, in addition to Li.

3. A method as claimed in claim 1, wherein the input material comprises nickel, manganese and cobalt, in addition to Li.

4. A method as claimed in claim 1, wherein the concentration of formic acid in the leaching medium is at least 80 wt. %.

5. A method as claimed in claim 1, wherein the concentration of formic acid in the leaching medium is at least 95 wt. %.

6. A method as claimed in claim 1, wherein the leaching medium comprises $H_2O_2$.

7. A method as claimed in claim 1, wherein the step of leaching Li from the input material to form a leachate involves heating to a temperature of at least 60° C.

8. A method as claimed in claim 1, wherein the step of leaching Li from the input material to form a leachate involves heating to a temperature of at least 80° C.

9. A method as claimed in claim 1, wherein the step of leaching Li from the input material to form a leachate involves heating to at least the boiling point of the leaching medium.

10. A method as claimed in claim 1, wherein the step of leaching Li from the input material to form a leachate involves heating under reflux.

11. A method as claimed in claim 1, wherein the leaching medium includes a non-metal sulphate salt.

12. A method as claimed in claim 1, wherein the leaching medium includes $(NH_4)_2SO_4$.

13. A method as claimed in claim 1, wherein the leaching is carried out with agitation of the input material.

14. A method as claimed in claim 13, wherein the agitation is carried out with stirring.

15. A method as claimed in claim 13, wherein the agitation is carried out with ultrasound.

* * * * *